United States Patent [19]

Gossett

[11] Patent Number: 4,821,712

[45] Date of Patent: Apr. 18, 1989

[54] BREATHING APPARATUS

[76] Inventor: Allen D. Gossett, 2202 Harrison #321, Wichita Falls, Tex. 76308

[21] Appl. No.: 174,768

[22] Filed: Mar. 29, 1988

[51] Int. Cl.[4] ..... A62B 7/00; A62B 9/00

[52] U.S. Cl. ..... 128/205.15; 128/205.21; 128/204.26; 128/204.28; 128/205.17

[58] Field of Search ..... 128/204.18, 204.28, 128/205.11, 205.13, 205.14, 205.15, 205.17, 205.24, 207.14, 207.16, 203.28, 205.21, 204.11, 204.12, 205.22

[56] References Cited

U.S. PATENT DOCUMENTS

| | | | |
|---|---|---|---|
| 2,428,425 | 10/1947 | Levitt | 128/205.21 |
| 2,696,211 | 12/1954 | Gatty | 128/205.21 |
| 3,291,121 | 12/1966 | Vizneau | 128/205.15 |
| 4,164,218 | 8/1979 | Martin | 128/202.26 |
| 4,221,216 | 9/1980 | Kranz | 128/201.28 |
| 4,362,153 | 12/1982 | Wilson et al. | 128/202.26 |
| 4,409,978 | 10/1983 | Bartos | 128/202.26 |
| 4,440,163 | 4/1984 | Spergel | 128/205.13 |
| 4,573,463 | 3/1986 | Hall | 128/205.24 |
| 4,696,295 | 9/1987 | Constance-Hughes | 128/202.26 |

FOREIGN PATENT DOCUMENTS

| | | | |
|---|---|---|---|
| 1136544 | 5/1957 | France | 128/205.17 |

*Primary Examiner*—Paul T. Sewell
*Assistant Examiner*—Kimberly L. Asher
*Attorney, Agent, or Firm*—Ross, Howison, Clapp & Korn

[57] ABSTRACT

A portable, emergency breathing apparatus is provided that comprises an elastomeric bladder adapted to receive an emergency supply of pressurized oxygen-containing gas; valve means adapted to inject the oxygen-containing gas into the elastomeric bladder; conduit means providing gaseous fluid communication between the elastomeric bladder and a mouthpiece; and valve means adapted to control the flow of the oxygen-containing gas from the elastomeric bladder through the conduit to the mouthpiece.

10 Claims, 1 Drawing Sheet

BREATHING APPARATUS

TECHNICAL FIELD

This invention relates to a breathing apparatus, and more particularly, to a portable, lightweight breathing apparatus for use in emergency situations.

BACKGROUND OF THE INVENTION

Breathing apparatus for use in emergency situations have previously been disclosed in the prior art. By way of example, such devices are disclosed in the following U.S. Pat. Nos.: 4,164,218; 4,221,216; 4,362,153; 4,409,978; 4,440,163; and 4,696,295. These prior patents disclose devices of varying complexity, but all have inherent problems or disadvantages that are overcome through use of the present invention.

Most of the emergency breathing devices disclosed in the prior art employ hoods or masks that are to be placed over the head and face of the user prior to use. Others are so heavy or cumbersome that they must be tied around the body of the user or else supported by one or both hands during use. Still others employ exhaust valves or filters for the purpose of venting or purifying exhaled gas.

Notwithstanding the capabilities of some of the more elaborate emergency breathing systems that have previously been disclosed or are presently being marketed, there remains a need for a very lightweight, portable, emergency breathing apparatus that is economical to manufacture and deploy; that can be placed in virtually instantaneous use with little or no prior training or instruction; that can be entirely supported from the mouth of the user, thereby freeing both hands for other purposes in emergency situations; and that will provide an emergency source of oxygen-containing gas for an interval of a few minutes in order to permit the user to extricate himself or herself from the emergency situation.

SUMMARY OF THE INVENTION

According to the present invention, a portable, lightweight, self-contained emergency breathing apparatus is provided that can be economically manufactured and deployed, and that does not need to be bound to the head or body of the user.

According to a preferred embodiment of the invention, an emergency breathing apparatus is provided that provides an inner, elastomeric bladder adapted to be prefilled with an oxygen-containing gas at a pressure greater than atmospheric; a mouthpiece; means for providing fluid communication between the inner elastomeric bladder and the mouthpiece; and manually operable means for intermittently controlling the flow of the oxygen containing gas from the pressurized elastomeric bladder to the mouthpiece. According to a particularly preferred embodiment of the invention, an outer bag is also provided that is disposed around the pressurized elastomeric bladder. The outer bag is preferably adapted to assist in protecting the pressurized elastomeric bladder and to retard the rate at which the pressurized, oxygen-containing gas escapes from the pressurized elastomeric bladder.

According to another particularly preferred embodiment of the invention, the mouthpiece of the invention can also be placed in fluid communication with the confined space between the pressurized elastomeric bladder and the outer bag so that, after receiving a quantity of fresh oxygen-containing gas from the pressurized elastomeric bladder, the user can repeatedly exhale into and inhale from the outer bag until such time as the gas in the outer bag no longer contains sufficient oxygen to be useful for breathing.

In yet another embodiment of the invention, the oxygen-containing gas in the elastomeric bladder is maintained at a sufficiently low pressure that the user can inhale from and exhale directly back into the pressurized elastomeric bladder. According to this embodiment of the invention, a flow control means is provided between the mouthpiece and the pressurized elastomeric bladder that can be set to remain in an open position without the constant application of manual force.

BRIEF DESCRIPTION OF THE DRAWINGS

The apparatus of the invention is further described and explained in relation to the following figures, in which like numerals are used to designate like parts.

DESCRIPTION OF THE PREFERRED EMBODIMENTS

Figure 1:
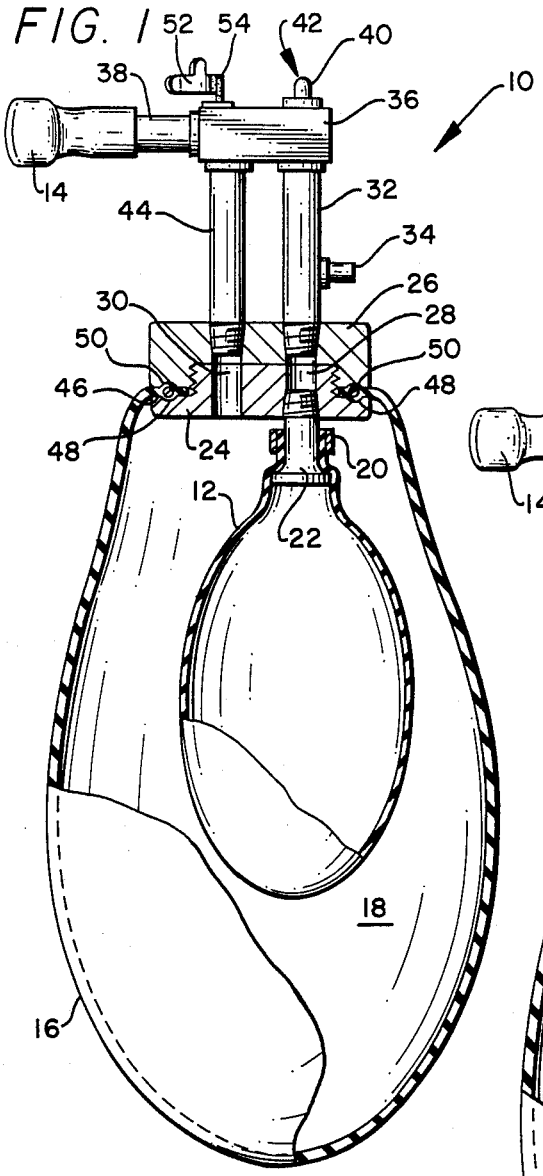
FIG. 1 is an elevation view, partially in section, depicting the embodiment of the invention wherein means are provided for exhaling through the mouthpiece into the outer bag.

Referring to FIG. 1, breathing apparatus 10 preferably comprises pressurized elastomeric bladder 12, mouthpiece 14, and outer bag 16. Mouthpiece 14 is preferably selected from well known, commercially available, flexible rubber devices such as those commonly employed with underwater breathing apparatus. Pressurized elastomeric bladder 12 is preferably selected from any rubbery or other expandable polymeric material that can satisfactorily contain air or another breathable oxygen-containing gas at pressures up to several atmospheres for an interval of up to a year or more, depending upon factors such as the thickness and permeability of the bladder. According to a preferred embodiment of the invention, pressurized elastomeric bladder 12 can comprise a conventional balloon fabricated from rubber having a moderate to heavy thickness. While elastomeric bladders comprising relatively thin-walled balloons can also be employed in the apparatus of the invention, it will become apparent upon reading this disclosure that thicker walls can contribute to durability and may assist in containing the pressurized oxygen-containing gas over longer time intervals.

Outer bag 16 is preferably constructed of a flexible, collapsible material that is either substantially nonelastomeric or less elastomeric than the pressurized elastomeric bladder 12. Outer bag 16 is desirably intended to provide an additional protective covering for pressurized elastomeric bladder 12, and also in the embodiment shown in FIG. 1, to provide a confined space 18 between pressurized elastomeric bladder 12 and outer bag 16 that can function as a low-pressure breathing chamber.

Mouth 20 of elastomeric bladder 12 is desirably disposed around flared nipple 22 which is in turn connected to lower support block 24 by threaded engagement or other similarly effective means. Mouth 20 can be secured to nipple 22 by the use of ties, spring clips, adhesives or the like. Lower support block 24 in turn threadedly engages upper support block 26. Lower support block 24 and upper support block 26 are desirably bored in such manner that, when threadedly engaged, they co-act to form coaxial, substantially cylindrical passageways 28, 30 therethrough. Nipple 32 is desirably connected such as by threading or the like to upper support block 26 and is coaxial with passageway 28 and nipple 22. Needle valve 34 is preferably of conventional design having a spring-loaded valve core that is normally closed, but opens when subjected to external pressure exerted against the valve stem to permit the passage of gas from an external source into nipple 32. Valve 34 is desirably mounted in the sidewall of nipple 32 and is adapted to receive pressurized oxygen-containing gas such as air from an external source such as a compressed air cylinder or a conventional pump.

Nipple 32 is preferably connected to valve block 36, which is internally bored to provide fluid communication from nipple 32 to nipple 38 and mouthpiece 14. While nipple 22, lower support block 24, upper support block 26, nipple 32, valve block 36 and nipple 38 are depicted as individual components in FIG. 1 that can be assembled from conventional, commercially available rigid plastic parts made from PVC or the like, it is understood that these parts can also be unwarily molded or otherwise fabricated from any other satisfactory lightweight materials to produce the apparatus of the invention. As used herein, the term "lightweight" refers to the weight of the parts or assembly, and not to the wall thickness or durability.

Valve 40 is disposed in valve block 36 and is adapted to selectively permit or block the flow of gas from pressurized elastomeric bladder 12 through nipple 22, passageway 28, nipple 32 and valve block 36 into nipple 38 and mouthpiece 14. Valve 40 is also normally closed. Whenever gas is being injected into the elastomeric bladder 12 through valve 34, valve 40 is closed.

Conversely, whenever valve 40 is opened through the application of manual pressure to button 42, valve 34 is closed so that oxygen containing gas is permitted to flow from elastomeric bladder 12 through-nipple 22, passageway 28 and nipple 32 through valve block 36 into nipple 38 and mouthpiece 14.

During use of the subject apparatus also shown in FIG. 1, button 42 on valve 40 is depressed until such time as the user has inhaled the desired quantity of oxygen-containing gas. Assuming that the user closes his lips around flexible rubber mouthpiece 14, any pressurized gas released from elastomeric bladder 12 that cannot be accommodated in the user's lungs will pass downward through nipple 44 into outer bag 16. Outer bag 16 preferably comprises an O-ring 46 or other similarly effective device for maintaining an airtight seal between breathing chamber 18 and the outside atmosphere. According to a preferred embodiment of the invention as shown in FIGS. 1 and 2, lower support block 24 and upper support block 26 are adapted by means of grooves 48, 50, respectively, to accommodate sealing ring 46 of outer bag 16.

Once the user has obtained fresh oxygen-containing gas from elastomeric bladder 12 through valve 40, button 42 is released, and the user can thereafter breathe back and forth through mouthpiece 14, nipples 38 and 44, into breathing chamber 18. Once the oxygen level in the gas has been depleted to an extent that further breathing becomes difficult, the user can once again release fresh oxygen-containing gas from elastomeric bladder 12 by depressing button 42 on valve 40.

Where breathing apparatus 10 is to be used in an emergency environment where the ambient atmosphere comprises smoke or poisonous gases, a conventional nose clip can also be provided and attached to breathing apparatus 10 by means of conventional hook and loop fastener 54, a snap, or some other similarly useful device.

Figure 2:
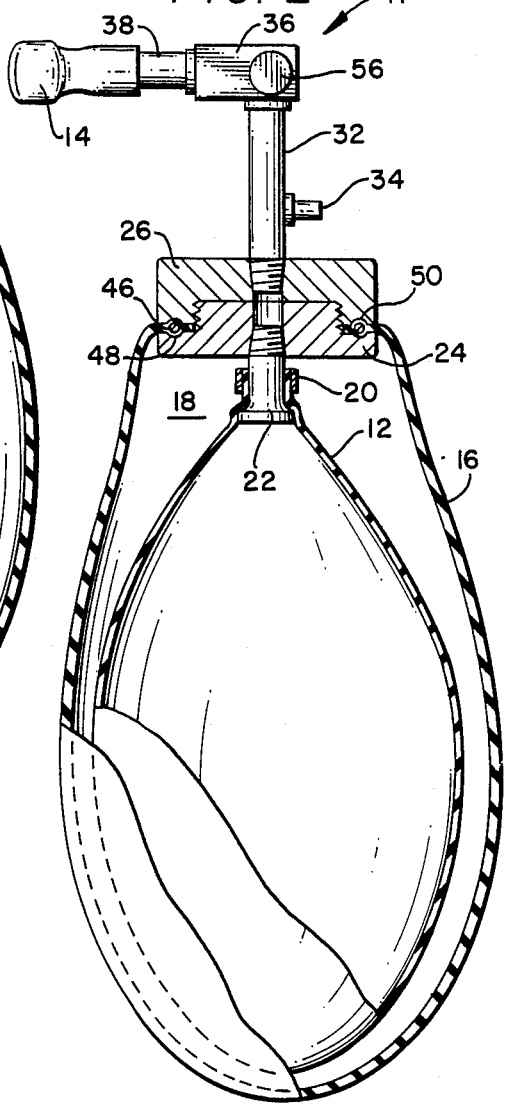
FIG. 2 is an elevation view, partially in section, depicting the embodiment of the invention wherein means are provided for exhaling back into the pressurized elastomeric bladder.

Referring to FIG. 2, another embodiment of the breathing apparatus 11 of the invention is provided that is similar in most respects to the embodiment of FIG. 1, except that means are not provided for exhaling through mouthpiece 14 into breathing chamber 18 between elastomeric bladder 12 and outer bag 16. Also, needle valve 40 as shown in FIG. 1 is replaced with a conventional ball valve having thumb wheel 56 adapted to be selectively operated so that the valve can be left in either an open or closed position as desired without the constant application of manual pressure.

In one mode of operation with the apparatus constructed as shown in FIG. 2, the user simply opens the valve in valve block 36, inhales oxygen-containing gas from pressurized elastomeric bladder 12, and exhales to the atmosphere. Alternatively, if desired, the embodiment shown in FIG. 2 can also be employed with a normally closed valve 40 as shown in FIG. 1 to avoid the unintentional loss of oxygen-containing gas should mouthpiece 14 become disengaged from the user. Similarly, if desired, the ball valve employed in the apparatus shown in FIG. 2 can also be used in lieu of the needle valve 40 in the apparatus as shown in FIG. 1.

With the valving configuration shown in FIG. 2, it is possible for the user to both inhale from and exhale into pressurized elastomeric bladder 12 provided that pressurized elastomeric bladder 12 is pressurized at low pressures slightly greater than atmospheric but not greater than the pressure at which the user would normally exhale gas from his lungs.

According to a preferred embodiment of the invention, the breathing apparatus as depicted in either FIG. 1 or 2 is fabricated from relatively inexpensive and lightweight plastic materials so that the entire apparatus can be conveniently supported from the mouth of the user, thereby freeing both hands for use in extricating the user or others from dangerous situations. By way of example and without limitation, emergency environments in which such a device might be useful could include homes, motel rooms, mines, aircraft, boats, automobiles, and the like. More generally, the apparatus of the invention is useful in any environment where the user might suddenly be engulfed in a non-breathable atmosphere or water.

It is further understood that the apparatus of the invention should be inspected periodically and can be recharged whenever it is discovered that the volume of oxygen containing gas remaining in the bladder has fallen below a minimum acceptable level. It will be apparent to one of ordinary skill in the art upon reading this disclosure that the apparatus as described in relation to FIG. 2 can also be constructed with a single bladder or bag within the scope of the invention.

Other embodiments of the subject invention will become apparent to those of ordinary skill in the art upon reading the present disclosure and it is intended to cover all such modifications and embodiments of this apparatus as fall within the scope of the appended claims.

What is claimed is:

1. Portable emergency breathing apparatus adapted to be supportable solely by the mouth of the user, said apparatus comprising an expandable bladder adapted to receive, store and release a breathable oxygen-containing gas;

a first normally closed valve means adapted to permit the introduction of said oxygen-containing gas into said bladder from an external source at a pressure greater than atmospheric pressure;

a mouthpiece adapted to be inserted into and maintained in the mouth of the user during use;

conduit means providing gaseous fluid communication between said bladder and said mouthpiece;

and a second valve means adapted to selectively control the release of said oxygen-containing gas from said bladder to said mouthpiece through said conduit means;

a bag disposed around said bladder so as to define a confined space therebetween, and a second conduit means producing gaseous fluid communication between said confined space and said mouthpiece.

2. The apparatus of claim 1 wherein said second valve means is a normally closed valve adapted to permit the flow of oxygen-containing gas from said bladder to said mouthpiece when intermittently subjected to the application of manual force.

3. The apparatus of claim 1 wherein said second valve means is adapted to be selectively opened through the application of manual force by the user and to remain open without constant application of manual force by the user until closed by the user.

4. The apparatus of claim 1 wherein said conduit means and said second conduit means cooperate to provide open gaseous fluid communication between said bladder and said confined space whenever said second valve means is open.

5. The apparatus of claim 1, wherein said second valve means is a normally closed valve adapted to permit the flow of oxygen-containing gas from said bladder to said mouthpiece when intermittently subjected to the application of manual force.

6. The apparatus of claim 1, wherein said second valve means is adapted to be selectively opened through the application of manual force by the user and to remain open without constant application of manual force by the user until closed by the user.

7. The apparatus of claim 1 wherein said bladder is elastomeric.

8. The apparatus of claim 1 wherein said bladder is elastomeric.

9. The apparatus of claim 1 wherein said mouthpiece is made of a flexible polymeric material.

10. The apparatus of claim 1 wherein said mouthpiece is made of a flexible polymeric material.

* * * * *